US006831532B2

(12) United States Patent
Fong et al.

(10) Patent No.: US 6,831,532 B2
(45) Date of Patent: Dec. 14, 2004

(54) PUSH-MODE LATCHING RELAY

(75) Inventors: Arthur Fong, Colorado Springs, CO (US); Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 107 days.

(21) Appl. No.: 10/413,067

(22) Filed: Apr. 14, 2003

(65) Prior Publication Data

US 2004/0200702 A1 Oct. 14, 2004

(51) Int. Cl.[7] ..... H01H 29/00

(52) U.S. Cl. ..... 335/47; 335/48; 335/58; 200/182

(58) Field of Search ..... 335/47–58; 200/182, 200/183, 187, 188, 209, 210, 214–219, 233–236

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Tomkewitsch et al. |
| 3,529,268 | A | 9/1970 | Rauterberg |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | SHO 36-18575 | 10/1961 |
| JP | SHO 47-21645 | 10/1972 |
| JP | 62-276838 | 12/1987 |
| JP | 01-294317 | 12/1988 |
| JP | 8-125487 | 5/1996 |
| JP | 9161640 A | 6/1997 |
| WO | WO99/46624 | 12/1999 |

OTHER PUBLICATIONS

Jonathan Simon, "A Liquid–Filled Microrelay With A Moving Mercury Microdrop" (Sep., 1997) Journal of Microelectromechinical Systems, vol. 6, No. 3, PP 208–216.

Marvin Glenn Wong, "A Piezoelectrically Actuated Liquid Metal Switch", May 2, 2002, patent application (pending), 12 pages of specification, 5 pages of claims, 1 page of abstract, and 10 sheets of drawings (Fig. 1–10).

(List continued on next page.)

*Primary Examiner*—Ramon M. Barrera

(57) ABSTRACT

An electrical relay that uses a conducting liquid in the switching mechanism. In the relay, a pair of fixed electrical contacts is held a small distance from a pair of moveable electrical contacts. The facing surfaces of the contacts each support a droplet of a conducting liquid, such as a liquid metal. A piezoelectric or magnetorestrictive actuator is energized to move the pair of moveable contacts, closing the gap between one of the fixed contacts and one of the moveable contacts, thereby causing conducting liquid droplets to coalesce and form an electrical circuit. At the same time, the gap between the other fixed contact and the other moveable contact is increased, thereby causing conducting liquid droplets to separate and break an electrical circuit. The actuator is then de-energized and the moveable electrical contacts return to their starting positions. The volume of liquid metal is chosen so that liquid metal droplets remain coalesced or separated because of surface tension in the liquid. The relay is amenable to manufacture by micromachining techniques.

19 Claims, 2 Drawing Sheets

U.S. PATENT DOCUMENTS

| | | | |
|---|---|---|---|
| 3,600,537 | A | 8/1971 | Twyford |
| 3,639,165 | A | 2/1972 | Rairden, III |
| 3,657,647 | A | 4/1972 | Beusman et al. |
| 4,103,135 | A | 7/1978 | Gomez et al. |
| 4,200,779 | A | 4/1980 | Zakurdaev et al. |
| 4,238,748 | A | 12/1980 | Goullin et al. |
| 4,245,886 | A | 1/1981 | Kolodzey et al. |
| 4,336,570 | A | 6/1982 | Brower |
| 4,419,650 | A | 12/1983 | John |
| 4,434,337 | A | 2/1984 | Becker |
| 4,475,033 | A | 10/1984 | Willemsen et al. |
| 4,505,539 | A | 3/1985 | Auracher et al. |
| 4,582,391 | A | 4/1986 | Legrand |
| 4,628,161 | A | 12/1986 | Thackrey |
| 4,652,710 | A | 3/1987 | Karnowsky et al. |
| 4,657,339 | A | 4/1987 | Fick |
| 4,742,263 | A | 5/1988 | Harnden, Jr. et al. |
| 4,786,130 | A | 11/1988 | Georgiou et al. |
| 4,797,519 | A | 1/1989 | Elenbaas |
| 4,804,932 | A | 2/1989 | Akanuma et al. |
| 4,988,157 | A | 1/1991 | Jackel et al. |
| 5,278,012 | A | 1/1994 | Yamanaka et al. |
| 5,415,026 | A | 5/1995 | Ford |
| 5,502,781 | A | 3/1996 | Li et al. |
| 5,644,676 | A | 7/1997 | Blomberg et al. |
| 5,675,310 | A | 10/1997 | Wojnarowski et al. |
| 5,677,823 | A | 10/1997 | Smith |
| 5,751,074 | A | 5/1998 | Prior et al. |
| 5,751,552 | A | 5/1998 | Scanlan et al. |
| 5,828,799 | A | 10/1998 | Donald |
| 5,841,686 | A | 11/1998 | Chu et al. |
| 5,849,623 | A | 12/1998 | Wojnarowski et al. |
| 5,874,770 | A | 2/1999 | Saia et al. |
| 5,875,531 | A | 3/1999 | Nellissen et al. |
| 5,886,407 | A | 3/1999 | Polese et al. |
| 5,889,325 | A | 3/1999 | Uchida et al. |
| 5,912,606 | A | 6/1999 | Nathanson et al. |
| 5,915,050 | A | 6/1999 | Russell et al. |
| 5,972,737 | A | 10/1999 | Polese et al. |
| 5,994,750 | A | 11/1999 | Yagi |
| 6,021,048 | A | 2/2000 | Smith |
| 6,180,873 | B1 | 1/2001 | Bitko |
| 6,201,682 | B1 | 3/2001 | Mooij et al. |
| 6,207,234 | B1 | 3/2001 | Jiang |
| 6,212,308 | B1 | 4/2001 | Donald |
| 6,225,133 | B1 | 5/2001 | Yamamichi et al. |
| 6,278,541 | B1 | 8/2001 | Baker |
| 6,304,450 | B1 | 10/2001 | Dibene, II et al. |
| 6,320,994 | B1 | 11/2001 | Donald et al. |
| 6,323,447 | B1 | 11/2001 | Kondoh |
| 6,351,579 | B1 | 2/2002 | Early et al. |
| 6,356,679 | B1 | 3/2002 | Kapany |
| 6,373,356 | B1 | 4/2002 | Gutierrez |
| 6,396,012 | B1 | 5/2002 | Bloomfield |
| 6,396,371 | B2 | 5/2002 | Streeter et al. |
| 6,408,112 | B1 | 6/2002 | Bartels |
| 6,446,317 | B1 | 9/2002 | Figueroa et al. |
| 6,453,086 | B1 | 9/2002 | Tarazona |
| 6,470,106 | B2 | 10/2002 | McClelland |
| 6,487,333 | B2 | 11/2002 | Fouquet |
| 6,501,354 | B1 | 12/2002 | Gutierrez et al. |
| 6,512,322 | B1 | 1/2003 | Fong et al. |
| 6,515,404 | B1 | 2/2003 | Wong |
| 6,516,504 | B2 | 2/2003 | Schaper |
| 6,559,420 | B1 | 5/2003 | Zarev |
| 6,633,213 | B1 | 10/2003 | Dove |
| 2002/0037128 | A1 | 3/2002 | Burger et al. |
| 2002/0146197 | A1 | 10/2002 | Yong |
| 2002/0150323 | A1 | 10/2002 | Nishida et al. |
| 2002/0168133 | A1 | 11/2002 | Saito |
| 2003/0035611 | A1 | 2/2003 | Shi |

OTHER PUBLICATIONS

Bhedwar, Homi C. et al. "Ceramic Multilayer Package Fabrication," Electronic Materials Handbook, Nov. 1989, pp. 460–469, vol. 1 Packaging, Section 4: Packages.

Kim, Joonwon et al. "A Micromechanical Switch with Electrostatically Driven Liquid–Metal Droplet," Sensors and Actuators, A: Physical. v 9798, Apr. 1, 2002, 4 pages.

TDB–ACC–NO:NB8406827, "Integral Power Resistors For Aluminum Substrate", IBM Technical Disclosure Bulletin, Jun. 1984, US, vol. 27, Issue No. 1B, p. 827.

PUSH-MODE LATCHING RELAY

CROSS REFERENCE TO RELATED APPLICATIONS

This application is related to the following co-pending U.S. Patent Applications, being identified by the below enumerated identifiers and arranged in alphanumerical order, which have the same ownership as the present application and to that extent are related to the present application and which are hereby incorporated by reference:

Application 10010448-1, titled "Piezoelectrically Actuated Liquid Metal Switch", filed May 2, 2002 and identified by Ser. No. 10/137,691;

Application 10010529-1, "Bending Mode Latching Relay", having the same filing date as the present application and identified by Ser. No. 10/413,068;

Application 10010531-1, "High Frequency Bending Mode Latching Relay", having the same filing date as the present application and identified by Ser. No. 10/412,912;

Application 10010570-1, titled "Piezoelectrically Actuated Liquid Metal Switch", filed May 2, 2002 and identified by Ser. No. 10/142,076;

Application 10010571-1, "High-frequency, Liquid Metal, Latching Relay with Face Contact", having the same filing date as the present application and identified by Ser. No. 10/412,991;

Application 10010572-1, "Liquid Metal, Latching Relay with Face Contact", having the same filing date as the present application and identified by Ser. No. 10/413,195;

Application 10010573-1, "Insertion Type Liquid Metal Latching Relay", having the same filing date as the present application and identified by Ser. No. 10/412,824;

Application 10010617-1, "High-frequency, Liquid Metal, Latching Relay Array", having the same filing date as the present application and identified by Ser. No. 10/413,278;

Application 10010618-1, "Insertion Type Liquid Metal Latching Relay Array", having the same filing date as the present application and identified by Ser. No. 10/412,880;

Application 10010634-1, "Liquid Metal Optical Relay", having the same filing date as the present application and identified by Ser. No. 10/413,267;

Application 10010640-1, titled "A Longitudinal Piezoelectric Optical Latching Relay", filed Oct. 31, 2001 and identified by Ser. No. 09/999,590;

Application 10010643-1, "Shear Mode Liquid Metal Switch", having the same filing date as the present application and identified by Ser. No. 10/413,314;

Application 10010644-1, "Bending Mode Liquid Metal Switch", having the same filing date as the present application and identified by Ser. No. 10/413,328;

Application 10010656-1, titled "A Longitudinal Mode Optical Latching Relay", having the same filing date as the present application and identified by Ser. No. 10/413,215;

Application 10010663-1, "Method and Structure for a Pusher-Mode Piezoelectrically Actuated Liquid Metal Switch", having the same filing date as the present application and identified by Ser. No. 10/413,098;

Application 10010664-1, "Method and Structure for a Pusher-Mode Piezoelectrically Actuated Liquid Metal Optical Switch", having the same filing date as the present application and identified by Ser. No. 10/412,895;

Application 10010790-1, titled "Switch and Production Thereof", filed Dec. 12, 2002 and identified by Ser. No. 10/317,597;

Application 10011055-1, "High Frequency Latching Relay with Bending Switch Bar", having the same filing date as the present application and identified by Ser. No. 10/413,237;

Application 10011056-1, "Latching Relay with Switch Bar", having the same filing date as the present application and identified by Ser. No. 10/413,099;

Application 10011064-1, "High Frequency Push-mode Latching Relay", having the same filing date as the present application and identified by Ser. No. 10/413,100;

Application 10011121-1, "Closed Loop Piezoelectric Pump", having the same filing date as the present application and identified by Ser. No. 10/412,857;

Application 10011329-1, titled "Solid Slug Longitudinal Piezoelectric Latching Relay", filed May 2, 2002 and identified by Ser. No. 10/137,692;

Application 10011344-1, "Method and Structure for a Slug Pusher-Mode Piezoelectrically Actuated Liquid Metal Switch", having the same filing date as the present application and identified by Ser. No. 10/412,869;

Application 10011345-1, "Method and Structure for a Slug Assisted Longitudinal Piezoelectrically Actuated Liquid Metal Optical Switch", having the same filing date as the present application and identified by Ser. No. 10/412,916;

Application 10011397-1, "Method and Structure for a Slug Assisted Pusher-Mode Piezoelectrically Actuated Liquid Metal Optical Switch", having the same filing date as the present application and identified by Ser. No. 10/413,070;

Application 10011398-1, "Polymeric Liquid Metal Switch", having the same filing date as the present application and identified by Ser. No. 10/413,094;

Application 10011410-1, "Polymeric Liquid Metal Optical Switch", having the same filing date as the present application and identified by Ser. No. 10/412,859;

Application 10011436-1, "Longitudinal Electromagnetic Latching Optical Relay", having the same filing date as the present application and identified by Ser. No. 10/412,868;

Application 10011437-1, "Longitudinal Electromagnetic Latching Relay", having the same filing date as the present application and identified by Ser. No. 10/413,329;

Application 10011458-1, "Damped Longitudinal Mode Optical Latching Relay", having the same filing date as the present application and identified by Ser. No. 10/412,894;

Application 10011459-1, "Damped Longitudinal Mode Latching Relay", having the same filing date as the present application and identified by Ser. No. 10/412,914;

Application 10020013-1, titled "Switch and Method for Producing the Same", filed Dec. 12, 2002 and identified by Ser. No. 10/317,963;

Application 10020027-1, titled "Piezoelectric Optical Relay", filed Mar. 28, 2002 and identified by Ser. No. 10/109,309;

Application 10020071-1, titled "Electrically Isolated Liquid Metal Micro-Switches for Integrally Shielded Microcircuits", filed Oct. 8, 2002 and identified by Ser. No. 10/266,872;

Application 10020073-1, titled "Piezoelectric Optical Demultiplexing Switch", filed April 10, 2002 and identified by Ser. No. 10/119,503;

Application 10020162-1, titled "Volume Adjustment Apparatus and Method for Use", filed Dec. 12, 2002 and identified by Ser. No. 10/317,293;

Application 10020231 -1, titled "Ceramic Channel Plate for a Switch", having the same filing date as the present application and identified by Ser. No. 10/317,960;

Application 10020241-1, "Method and Apparatus for Maintaining a Liquid Metal Switch in a Ready-to-Switch Condition", having the same filing date as the present application and identified by Ser. No. 10/413,002;

Application 10020242-1, titled "A Longitudinal Mode Solid Slug Optical Latching Relay", having the same filing date as the present application and identified by Ser. No. 10/412,858;

Application 10020473-1, titled "Reflecting Wedge Optical Wavelength Multiplexer/Demultiplexer", having the same filing date as the present application and identified by Ser. No. 10/413,270;

Application 10020540-1, "Method and Structure for a Solid Slug Caterpillar Piezoelectric Relay", having the same filing date as the present application and identified by Ser. No. 10/413,088;

Application 10020541-1, titled "Method and Structure for a Solid Slug Caterpillar Piezoelectric Optical Relay", having the same filing date as the present application and identified by Ser. No. 10/413,196;

Application 10020698-1, titled "Laser Cut Channel Plate for a Switch", having the same filing date as the present application and identified by Ser. No. 10/317,932:

Application 10030438-1, "Inserting-finger Liquid Metal Relay", having the same filing date as the present application and identified by Ser. No. 10/413,187;

Application 10030440-1, "Wetting Finger Liquid Metal Latching Relay", having the same filing date as the present application and identified by Ser. No. 10/413,058;

Application 10030521-1, "Pressure Actuated Optical Latching Relay", having the same filing date as the present application and identified by Ser. No. 10/412,874;

Application 10030522-1, "Pressure Actuated Solid Slug Optical Latching Relay", having the same filing date as the present application and identified by Ser. No. 10/413,162; and Application 10030546-1, "Method and Structure for a Slug Caterpillar Piezoelectric Reflective Optical Relay", having the same filing date as the present application and identified by Ser. No. 10/412,910.

FIELD OF THE INVENTION

The invention relates to the field of micro-electromechanical systems (MEMS) for electrical switching, and in particular to a latching relay with liquid metal contacts and piezoelectric or magnetorestrictive actuators.

BACKGROUND

Liquid metals, such as mercury, have been used in electrical switches to provide an electrical path between two conductors. An example is a mercury thermostat switch, in which a bimetal strip coil reacts to temperature and alters the angle of an elongated cavity containing mercury. The mercury in the cavity forms a single droplet due to high surface tension. Gravity moves the mercury droplet to the end of the cavity containing electrical contacts or to the other end, depending upon the angle of the cavity. In a manual liquid metal switch, a permanent magnet is used to move a mercury droplet in a cavity.

Liquid metal is also used in relays. A liquid metal droplet can be moved by a variety of techniques, including electrostatic forces, variable geometry due to thermal expansion/contraction and magneto-hydrodynamic forces.

Conventional piezoelectric relays either do not latch or use residual charges in the piezoelectric material to latch or else activate a switch that contacts a latching mechanism.

Rapid switching of high currents is used in a large variety of devices, but provides a problem for solid-contact based relays because of arcing when current flow is disrupted. The arcing causes damage to the contacts and degrades their conductivity due to pitting of the electrode surfaces.

Micro-switches have been developed that use liquid metal as the switching element and the expansion of a gas when heated to move the liquid metal and actuate the switching function. Liquid metal has some advantages over other micro-machined technologies, such as the ability to switch relatively high powers (about 100 mW) using metal-to-metal contacts without micro-welding or overheating the switch mechanism. However, the use of heated gas has several disadvantages. It requires a relatively large amount of energy to change the state of the switch, and the heat generated by switching must be dissipated effectively if the switching duty cycle is high. In addition, the actuation rate is relatively slow, the maximum rate being limited to a few hundred Hertz.

SUMMARY

An electrical relay is disclosed that uses a conducting liquid in the switching mechanism. In the relay, a pair of fixed electrical contacts is positioned between a pair of moveable electrical contacts. The facing surfaces of the contacts each support a droplet of a conducting liquid, such as a liquid metal. A piezoelectric or magnetorestrictive actuator is energized to move the pair of moveable contacts, closing the gap between one of the fixed contacts and one of the moveable contacts, thereby causing conducting liquid droplets to coalesce and form an electrical circuit. At the same time, the gap between the other fixed contact and the other moveable contact is increased, thereby causing conducting liquid droplets to separate and break an electrical circuit.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description of the invention, which describes certain exemplary embodiments of the invention, taken in conjunction with the accompanying drawings in which:

DETAILED DESCRIPTION

Figure 1:
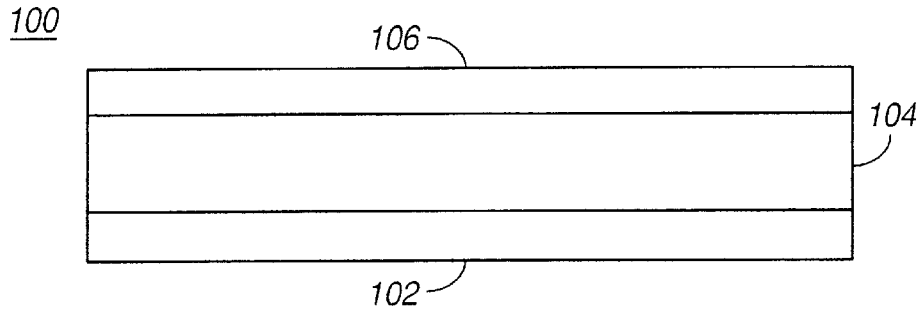
FIG. 1 is a side view of a latching relay consistent with certain embodiments of the present invention.

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described. In the description below, like reference numerals are used to describe the same, similar or corresponding parts in the several Views of the drawings.

The electrical relay of the present invention uses a conducting fluid, such as liquid metal, to bridge the gap between two electrical contacts and thereby complete an electrical circuit between the contacts. Two fixed electrical contacts are positioned between a pair of movable electrical contacts. Each of the facing surfaces of the contacts supports a droplet of a conducting liquid. In an exemplary embodiment, the conducting liquid is a liquid metal, such as mercury, with high conductivity, low volatility and high surface tension. A piezoelectric or magnetorestrictive actuator is coupled to a contact carrier that supports the two moveable electrical contacts. In the sequel, piezoelectric actuators and magnetorestrictive actuators will be collectively referred to as "piezoelectric actuators". When energized, the actuator moves the contact carrier so that a first moveable contact moves towards a first fixed contact, causing the two conducting liquid droplets to coalesce and complete an electrical circuit between the contacts. The relative positioning of the contacts is such that as the first moveable contact moves towards the first fixed contact, the second moveable contact moves away from the second fixed contact. After the switch-state has changed the piezoelectric actuator is de-energized and the moveable contacts return to their starting positions. The conducting liquid droplets remain coalesced because the volume of conducting liquid is chosen so that surface tension holds the droplets together. The electrical circuit is broken again by energizing the actuator to move the first moveable electrical contact away from the first fixed electrical contact to break the surface tension bond between the conducting liquid droplets. The droplets remain separated when the actuator is de-energized provided there is insufficient liquid to bridge the gap between the contacts. The relay is amenable to manufacture by micro-machining techniques.

When a magnetorestrictive actuator, such as Terfenol element, is used, the actuator is energized by applying a magnetic field across it. The field may be generated by electrical coils for example.

FIG. 1 is a side view of an embodiment of a latching relay of the present invention. Referring to FIG. 1, the relay 100 comprises three layers: a circuit substrate 102, a switching layer 104 and a cap layer 106. These three layers form the relay housing. The circuit substrate 102 supports electrical connections to the elements in the switching layer and provides a lower cap to the switching layer. The circuit substrate 102 may be made of a ceramic or silicon, for example, and is amenable to manufacture by micro-machining techniques, such as those used in the manufacture of micro-electronic devices. The switching layer 104 may be made of ceramic or glass, for example, or may be made of metal coated with an insulating layer (such as a ceramic). The cap layer 106 covers the top of the switching layer 108, and seals the switching cavity 108. The cap layer 106 may be made of ceramic, glass, metal or polymer, for example, or combinations of these materials. Glass, ceramic or metal is used in an exemplary embodiment to provide a hermetic seal.

Figure 2:
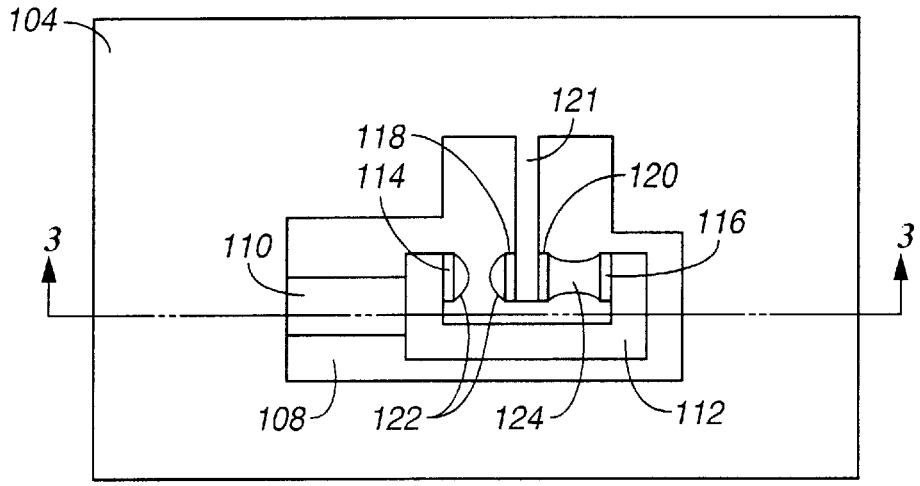
FIG. 2 is a top view of a latching relay with the cap layer removed consistent with certain embodiments of the present invention.

FIG. 2 is a top view of the relay with the cap layer removed. Referring to FIG. 2, the switching layer 104 incorporates a switching cavity 108. The switching cavity 108 is sealed below by the circuit substrate 102 and sealed above by the cap layer 106. The cavity may be filled with an inert gas. An extendible piezoelectric element 110 is attached to the switching layer and is operable to move a rigid contact carrier 112. The contact carrier 112 supports moveable electrical contacts 114 and 116. Fixed electrical contacts 118 and 120 are attached to a bar 121 which may be an integral part of the switching layer 104. The fixed electrical contacts may be electrically connected to each other. The exposed faces of the contacts are wettable by a conducting liquid, such as a liquid metal. The surfaces between the contacts are non-wettable to prevent liquid migration. In operation, the length of the actuator 110 is increased or decreased to move the free end of the actuator towards or away from the bar 121. The surfaces of the contacts support droplets of conducting liquid. In FIG. 2, the liquid between contacts 114 and 118 is separated into two droplets 122, one on each of the contacts 114 and 118. The liquid between contacts 120 and 116 is coalesced into a single droplet 124. Thus, there is an electrical connection between the contacts 120 and 116, but no connection between the contacts 114 and 118.

When the free end of the actuator 110 is moved towards the bar 121, the first moveable contact 114 is moved towards the first fixed contact 118, and the second moveable contact 116 is moved away from the second fixed contact 120. Conversely, when the free end of the actuator is moved away from the bar 112, the first moveable contact 114 is moved away from the first fixed contact 118, and the second moveable contact 116 is moved towards the second fixed contact 120. When the gap between the contacts 114 and 118 is great enough, the conducting liquid is insufficient to bridge the gap between the contacts and the conducting liquid connection is broken. When the gap between the contacts 120 and 116 is small enough, the liquid droplets on the two contacts coalesce with each other and form an electrical connection. The droplets of conducting liquid are held in place by the surface tension of the fluid. Due to the small size of the droplets, the surface tension dominates any body forces on the droplets and so the droplets are held in place.

Figure 3:
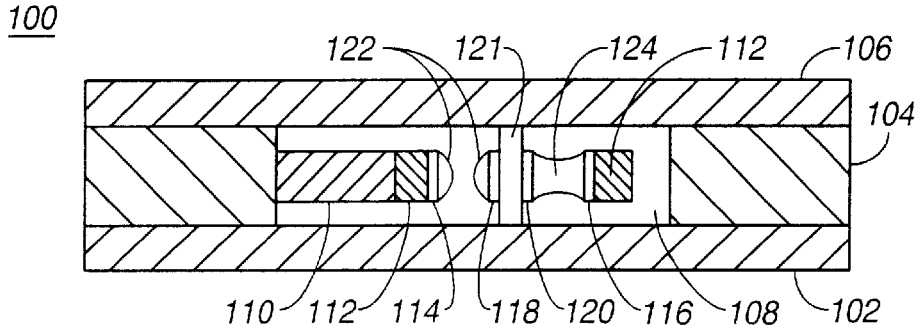
FIG. 3 is a sectional view of a latching relay consistent with certain embodiments of the present invention.

FIG. 3 is a sectional view through section 3-3 of the latching relay shown in FIG. 2. The view shows the three layers: the circuit substrate 102, the switching layer 104 and the cap layer 106. The contact carrier 112 is supported from the free end of the actuator 110 and is moveable within the switching channel 108. Electrical connection traces (not shown) to supply control signals to the actuator 110 may be deposited on the upper surface of the circuit substrate 102 or pass through vias in the circuit substrate. Similarly, electrical connection traces to the contact pads are deposited on the upper surface of the circuit substrate 102. External connections may be made through solder balls on the underside of the circuit substrate or via short wirebonds to pads at the ends of the circuit traces.

The use of mercury or other liquid metal with high surface tension to form a flexible, metal-to-metal electrical connection results in a relay with high current capacity that avoids pitting and oxide buildup caused by local heating.

Figure 4:
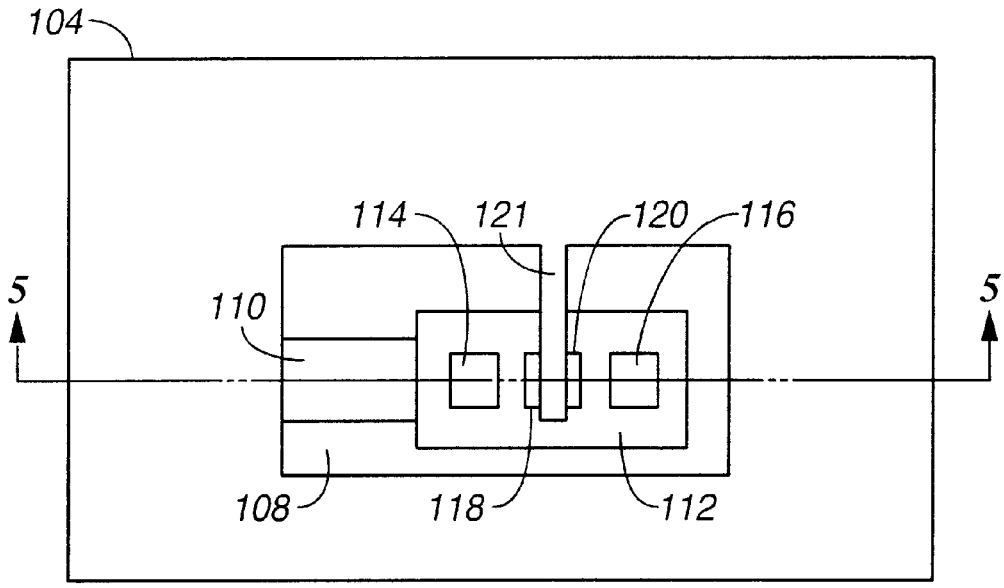
FIG. 4 is a top view of a further embodiment of a latching relay with the cap layer removed consistent with certain embodiments of the present invention.

A further embodiment of the present invention is shown in FIG. 4. In FIG. 4 the cap layer and the conducting liquid have been removed. Referring to FIG. 4, the moveable contacts 114 and 116 are attached to the upper horizontal surface of the contact carrier, rather than to the vertical surfaces. The contacts 114 and 118 are thus positioned at right angles to each other, rather than face to face. The contacts 120 and 116 are similarly at right angles. One advantage of this embodiment is that horizontal contacts are easier to form in some micro-machining processes. The operation of the relay is the same as the embodiment described above with reference to FIG. 2 and FIG. 3.

Figure 5:
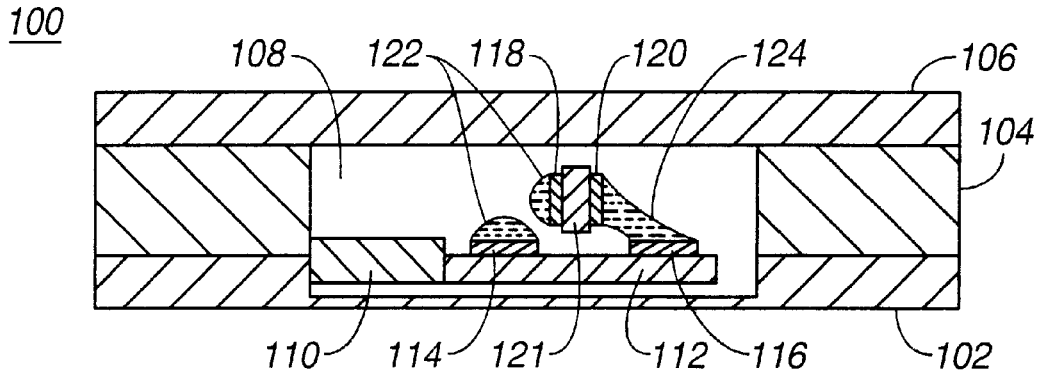
FIG. 5 is a sectional view of the further embodiment of a latching relay consistent with certain embodiments of the present invention.

FIG. 5 is a sectional view through the section 5—5 shown in FIG. 4. The conducting liquid droplet 124 fills the gap between contacts 120 and 116 and completes the electrical circuit between the contacts. A control signal applied to the piezoelectric actuator 110 causes it to deform in an extensional mode, moving the contact carrier 112 and increasing the gap between the contacts 120 and 116 to break the surface tension bond in the liquid 124. The liquid separates into two droplets, one on each contact, and the electrical circuit is broken. At the same time, the contacts 114 and 118 are moved closer together and the droplets 122 coalesce to complete the circuit between contacts 114 and 118. The liquid volume is chosen so that when the actuator is de-energized and returns to its undeflected position, the coalesced droplets remain coalesced and the separated droplets remain separated. In this way the relay is latched into the new switch-state.

The relay may be used to switch a signal between two terminals.

While the invention has been described in conjunction with specific embodiments, it is evident that many alternatives, modifications, permutations and variations will become apparent to those of ordinary skill in the art in light of the foregoing description. Accordingly, the present invention is intended to embrace all such alternatives, modifications and variations as fall within the scope of the appended claims.

What is claimed is:

1. An electrical relay comprising:

a relay housing comprising a switching cavity;

first and second moveable electrical contacts, each having a wettable surface;

a moveable contact carrier in the switching cavity supporting the first and second moveable electrical contacts;

first and second fixed electrical contacts attached to the relay housing in the switching cavity between the first and second moveable electrical contacts, the first and second fixed electrical contacts each having a wettable surface;

a first conducting liquid volume in wetted contact with the first moveable electrical contact and the first fixed electrical contact;

a second conducting liquid volume in wetted contact with the second moveable electrical contact and the second fixed electrical contact; and an actuator in a rest position, coupling the contact carrier to the relay housing and operable to move the contact carrier in a first direction, to reduce the distance between the first moveable electrical contact and the first fixed electrical contact and increase the distance between the second moveable electrical contact and the second fixed electrical contact, and a second direction to increase the distance between the first moveable electrical contact and the first fixed electrical contact and decrease the distance between the second moveable electrical contact and the second fixed electrical contact, wherein:

motion of the contact carrier in the first direction causes the first conducting liquid volume to form a connection between the first moveable electrical contact and the first fixed electrical contact and breaks a connection formed by the second conducting liquid volume between the second moveable electrical contact and the second fixed electrical contact; and motion of the contact carrier in the second directions breaks the connection formed by the first conducting liquid volume between the first moveable electrical contact and the first fixed electrical contact and causes the second conducting liquid to form a connection between the second moveable electrical contact and the second fixed electrical contact.

2. An electrical relay in accordance with claim 1, wherein the actuator is a piezoelectric actuator.

3. An electrical relay in accordance with claim 1, wherein the first and second conducting liquid volumes are liquid metal droplets.

4. An electrical relay in accordance with claim 1, wherein the first and second conducting liquid volumes are mercury.

5. An electrical relay in accordance with claim 1, wherein the first and second conducting liquid volumes are such that connected volumes remain connected when the actuator is returned to its rest position, and separated volumes remain separated when the actuator is returned to its rest position.

6. An electrical relay in accordance with claim 1, further comprising:

a circuit substrate supporting electrical connections to the actuator, the first and second moveable electrical contacts and the first and second fixed electrical contacts;

a cap layer; and a switching layer positioned between the circuit substrate and the cap layer and having the switching cavity formed therein.

7. An electrical relay in accordance with claim 6, wherein at least one of the electrical connections to the first and second fixed electrical contacts and the first and second moveable electrical contacts passes through the circuit substrate and terminates in a solder ball.

8. An electrical relay in accordance with claim 6, wherein at least one of the electrical connections to the first and second fixed electrical contacts and the first and second moveable electrical contacts is a trace deposited on the surface of the circuit substrate.

9. An electrical relay in accordance with claim 6, wherein at least one the electrical connections to the first and second fixed electrical contacts and the first and second moveable electrical contacts terminates at an edge of the switching layer.

10. An electrical relay in accordance with claim 6, manufactured by a method of micro-machining.

11. An electrical relay in accordance with claim 1, wherein the first and second fixed electrical contacts are electrically coupled to each other.

12. An electrical relay in accordance with claim 1, wherein the first and second moveable electrical contacts are electrically coupled to each other.

13. A method for switching between a first electrical circuit, between a first movable contact and a first fixed contact, and a second electrical circuit, between a second moveable contact and a second fixed contact, in a relay, the method comprising:

if the first electrical circuit is to be selected:

energizing an actuator to move a contact carrier supporting the first and second moveable contacts in a first direction, thereby moving the first moveable contact towards the first fixed contact so that a first conducting liquid, supported by at least one of the first moveable contact and the first fixed contact, wets between the first moveable contact and the first fixed contact and completes the first electrical circuit; and if the second electrical circuit is to be selected:

energizing the actuator to move the contact carrier in a second direction, thereby moving the second moveable contact towards the second fixed contact so that a second conducting liquid, supported by at least one of the second moveable contact and the second fixed contact, wets between the second moveable contact and the second fixed contact and completes the second electrical circuit.

14. A method in accordance with claim 13, wherein:

motion of the contact carrier in the first direction moves the second moveable contact away from the second fixed contact, so that the second conducting liquid cannot wet between the second moveable contact and the second fixed contact, thereby breaking the second electrical circuit; and motion of the contact carrier in the second direction moves the first moveable contact away from the first fixed contact, so that the first conducting liquid cannot wet between the first moveable contact and the first fixed contact, thereby breaking the first electrical circuit.

15. A method in accordance with claim 14, further comprising:

if the first electrical circuit is to be selected:

de-energizing the actuator after the first conducting liquid wets between the first moveable contact and the first fixed contact; and if the second electrical circuit is to be selected:

de-energizing the actuator after the second conducting liquid wets between the second moveable contact and the second fixed contact.

16. A method in accordance with claim 14, wherein the first actuator is a piezoelectric actuator and wherein energizing the first actuator comprises applying an electrical voltage across the piezoelectric actuator.

17. A method in accordance with claim 14, wherein the first actuator is a magnetorestrictive actuator and wherein energizing the first actuator comprises applying a magnetic field across the magnetorestrictive actuator.

18. An electrical relay comprising:

a relay housing comprising a switching cavity;

first and second moveable electrical contacts, each having a wettable surface;

a moveable contact carrier in the switching cavity supporting the first and second moveable electrical contacts;

first and second fixed electrical contacts attached to the relay housing in the switching cavity between the first and second moveable electrical contacts, the first and second fixed electrical contacts each having a wettable surface;

a first conducting liquid volume in wetted contact with the first moveable electrical contact and the first fixed electrical contact;

a second conducting liquid volume in wetted contact with the second moveable electrical contact and the second fixed electrical contact; and means for moving the contact carrier that couples the contact carrier to the relay housing;

wherein motion of the contact carrier in the first direction causes the first conducting liquid volume to form a connection between the first moveable electrical contact and the first fixed electrical contact and breaks a connection formed by the second conducting liquid volume between the second moveable electrical contact and the second fixed electrical contact; and wherein motion of the contact carrier in the second directions breaks the connection formed by the first conducting liquid volume between the first moveable electrical contact and the first fixed electrical contact and causes the second conducting liquid to form a connection between the second moveable electrical contact and the second fixed electrical contact.

19. An electrical relay in accordance with claim 18, wherein the means for moving is operable to move the contact carrier in a first direction to reduce the distance between the first moveable electrical contact and the first fixed electrical contact and increase the distance between the second moveable electrical contact and the second fixed electrical contact, and to move the contact carrier in a second direction to increase the distance between the first moveable electrical contact and the first fixed electrical contact and decrease the distance between the second moveable electrical contact and the second fixed electrical contact.

* * * * *